US009239208B2

(12) United States Patent
Miller et al.

(10) Patent No.: US 9,239,208 B2
(45) Date of Patent: Jan. 19, 2016

(54) INTEGRATED LEVELER AND RAIL PLATFORM ASSEMBLY FOR A FIREARM

(71) Applicant: Mega Arms LLC, Centralia, WA (US)

(72) Inventors: Michael A. Miller, Tenino, WA (US); Timothy D. Dabner, Olympia, WA (US)

(73) Assignee: Mega Arms LLC, Centralia, WA (US)

( * ) Notice: Subject to any disclaimer, the term of this patent is extended or adjusted under 35 U.S.C. 154(b) by 0 days.

(21) Appl. No.: 14/337,970

(22) Filed: Jul. 22, 2014

(65) Prior Publication Data

US 2015/0168096 A1 Jun. 18, 2015

Related U.S. Application Data

(60) Provisional application No. 61/915,075, filed on Dec. 12, 2013.

(51) Int. Cl.

| | |
|---|---|
| ***F41C 27/00*** | (2006.01) |
| ***F41C 23/16*** | (2006.01) |
| ***F41G 1/44*** | (2006.01) |

(52) U.S. Cl.

CPC .. *F41C 23/16* (2013.01); *F41G 1/44* (2013.01)

(58) Field of Classification Search

CPC ..... F41A 11/00; F41A 11/02; F41C 27/00; F41C 23/16; F41C 7/00

USPC ..... 42/90, 71.01, 75.01, 75.02, 75.03, 94; 89/191.01

See application file for complete search history.

(56) References Cited

U.S. PATENT DOCUMENTS

| | | | | |
|---|---|---|---|---|
| 3,198,076 | A * | 8/1965 | Stoner | F41A 3/26 42/75.02 |
| 4,729,186 | A * | 3/1988 | Rieger | F41A 21/484 42/75.04 |
| 5,590,484 | A * | 1/1997 | Mooney | F41G 1/16 42/111 |
| 5,900,577 | A * | 5/1999 | Robinson | F41A 11/02 89/156 |
| 6,694,660 | B1 * | 2/2004 | Davies | F41A 21/482 42/71.01 |
| RE39,465 | E * | 1/2007 | Swan | 42/124 |
| 8,234,808 | B2 * | 8/2012 | Lewis | F41A 3/26 42/1.01 |
| 8,561,337 | B2 | 10/2013 | Lewis et al. | |
| 2015/0168096 | A1 * | 6/2015 | Miller | F41C 27/00 42/71.01 |

* cited by examiner

*Primary Examiner* — Michael David

(74) *Attorney, Agent, or Firm* — Miller Nash Graham & Dunn LLP; Kathleen T. Petrich

(57) ABSTRACT

An integrated leveler assembly in combination with a rail portion for an upper receiver and a handguard, where the upper receiver and handguard are core components of a modular rifle assembly. The integrated leveler assembly is configured to fit within a slot formed between the two aligned end-to-end rail portions such that the integrated leveling assembly may not extend above the combined rail portions and the rail portions form a single aligned rail platform. The integrated leveler assembly includes a liquid-filled level vial that forms a bubble, a level vial barrel receiver, and fasteners to secure the integrated leveler assembly to the two rail portions of the rail platform. The integrated leveler assembly may include an extension spring, guide slot, lock pin, and cam lock, along with a separate barrel that axially receives the level vial receiver with an extension spring between the level vial receiver and the barrel.

7 Claims, 12 Drawing Sheets

INTEGRATED LEVELER AND RAIL PLATFORM ASSEMBLY FOR A FIREARM

RELATED APPLICATIONS

This application claims priority to U.S. provisional patent application Ser. No. 61/915,075 filed on Dec. 12, 2013, the contents of which are fully incorporated herein by reference.

TECHNICAL FIELD

The present invention relates to rail platform assemblies (typically including an upper receiver and a handguard) for firearms. Particularly, the present invention relates an integrated leveler positioned within a rail platform of a firearm to provide integrated, versatile, and compact anti-cant functionality.

BACKGROUND OF THE INVENTION

Rail platforms are commonly used in connection with automatic and semi-automatic rifles, such as military M-16 rifles and AR 15 type rifles, respectively. A rail platform typically corresponds to an upper receiver of a rifle and sometimes to both an upper receiver and a handguard that covers the barrel of the rifle. The rail platform accommodates a variety of accessories, such as lights, additional scopes, and anti-cant (leveling) devices. Known anti-cant devices are added in the field and extend externally of the handguard and rail platform. A user has to put up with the anti-cant device extending outwardly of the rail platform and can have impaired vision when shooting the rifle after leveling the rifle via the anti-cant device, because it is impractical to remove the anti-cant accessory once the rifle is aligned. Further, it can be time consuming and awkward to add and remove accessories in the field, especially when timing is of the essence. Furthermore, externally-extending rifle accessories are more likely to be damaged or entangled with brush or clothing.

BRIEF SUMMARY OF THE INVENTION

The present invention is directed to a rail platform with an anti-cant feature (leveler) that is integrated with a rail platform. The rail platform may be configured to be in two pieces: a first rail portion to be configured with an upper receiver for a firearm and a second rail portion to be configured with a handguard that itself is configured to receive a barrel assembly of a firearm. Each rail portion may include a plurality of outwardly extending and spaced apart upper ridges that laterally span the rail platform. The two rail portions are aligned end to end to form a slot between the two rail portions. The slot is configured to receive an anti-cant leveler. Alternatively, the rail platform may be configured in one piece that is configured with its respective upper receiver and handguard portion, with a slot between the two at the rail platform.

The leveler, which is configured to be received within the slot, includes a level vial and a level vial barrel receiver that may be axially received into a separate barrel having a cam lock and guide slot. The level vial is filled with leveling liquid that creates a visible bubble that can be externally visible of the level vial receiver when the level vial is axially received into the level vial receiver. In the embodiment with a separate barrel having a cam lock and guide slot, a spring biases the level vial receiver against an end of the barrel. When the level vial receiver pushes against the spring, the position can be held by a retaining pin that locks the leveler when the retaining pin is moved into the cam lock. In this way, the leveler can move between an open position and a closed and locked position.

According to one aspect of the invention, the end of the leveler may be knurled making it easier to move the leveler between the open and closed and locked position with a single fingertip.

Fasteners secure the leveler within the slot of the rail platform. The assembled leveler is compact and may not extend above the top portions of adjacent upper ridges. Further, when the leveler is closed and locked, the leveler barely extends past the lateral sides of the rail platform.

The fasteners may be spaced apart and oppositely situated from each other relative to the leveler, with the slot accommodating this particular shape. The leveler can be rotated 180 degrees so that the integrated leveler can be used for both right hand and left hand operations.

These and other advantages are discussed and/or illustrated in more detail in the DRAWINGS, the CLAIMS, and the DETAILED DESCRIPTION OF THE INVENTION.

BRIEF DESCRIPTION OF THE DRAWINGS

The accompanying Figures, which are incorporated in and constitute a part of this specification, illustrate various exemplary embodiments.

DETAILED DESCRIPTION OF THE INVENTION

Figure 1:
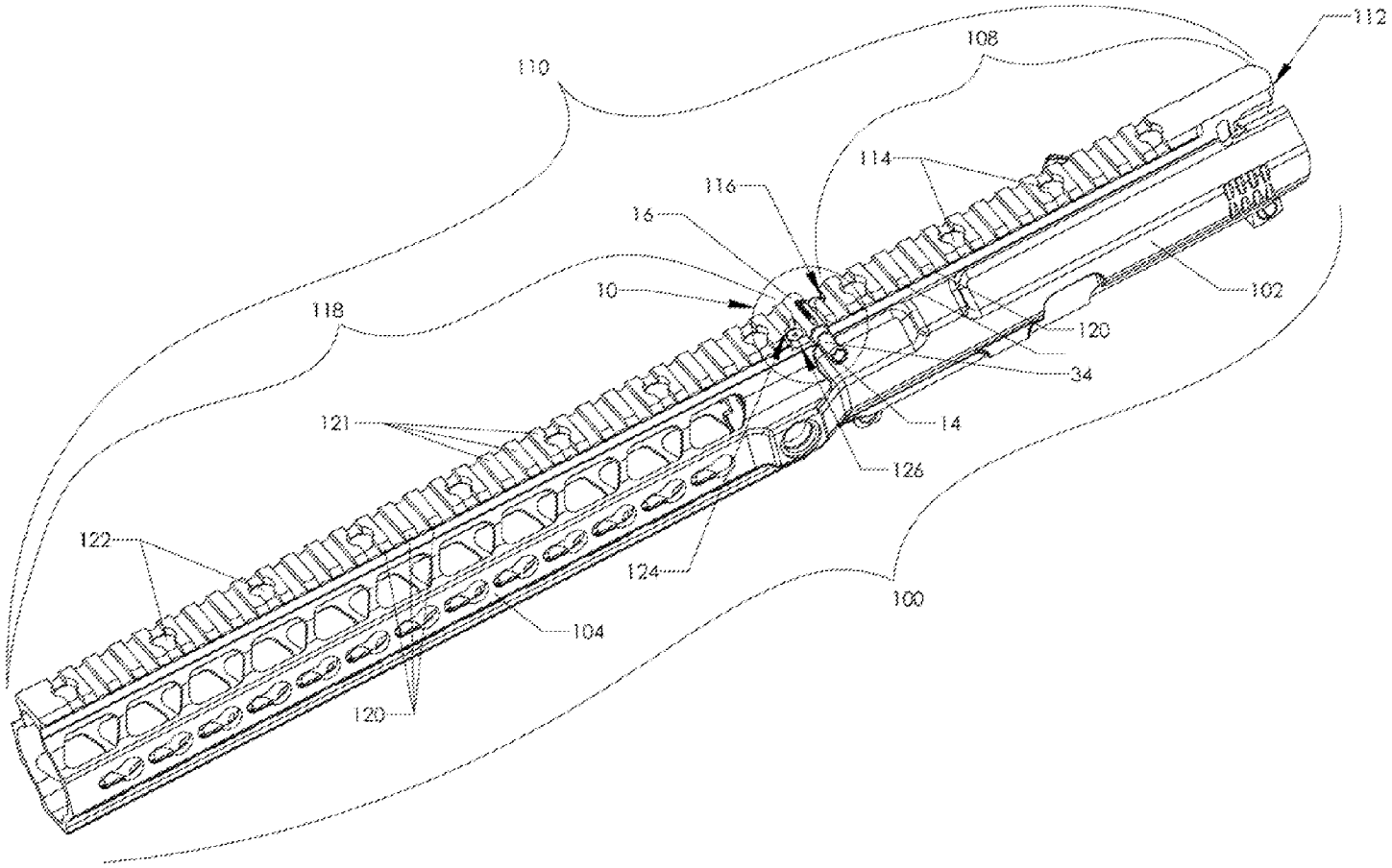
FIG. 1 is a perspective view illustrating an upper receiver having an integrated leveler assembly that spans between rail portions that form a rail platform and that each rail portion corresponds to an upper receiver and a handguard, respectively, for a firearm.

Referring to FIGS. 1-14, and according to one aspect of the present invention, an integrated leveler assembly 10 is illustrated that provides an anti-cant (leveling) function to a combined upper receiver/handguard assembly 100 for a firearm (not illustrated). The combined upper receiver/handguard assembly 100 comprises an upper receiver portion 102 that is configured to receive a bolt carrier (not illustrated) of the firearm, and a handguard portion 104 that is configured to receive a barrel assembly (also not illustrated) of the firearm via a barrel nut. The upper receiver portion 102 and the handguard portion 104 are adjoined end to end to form a visually unitary combined upper receiver/handguard assembly 100. A longitudinal bore 106 extends through both the upper receiver portion 102 and handguard portion 104.

The upper receiver portion 102 includes an elongated upper receiver rail portion 108 that extends longitudinally of the upper receiver portion. Together the upper receiver rail portion and the handguard rail portion form an elongated rail platform 110 that may be unitary or formed from separate rail platform portions. The rail platform may include a plurality of laterally-extending upper ridges 120 generally equally spaced apart and extending along the elongated upper receiver rail portion to form a top portion 112 of the upper receiver portion. One or more openings 114 may be added to elongated upper receiver rail portion 108 in which to accommodate an optional rifle accessory (not illustrated) such as a scope or a light fixture. A partial slot 116 is created at one end of upper receiver rail portion 108.

In similar fashion to the upper receiver portion, handguard portion 104 also includes an elongated handguard rail portion 118 that extends longitudinally of the handguard portion. Handguard rail portion 118 may include a plurality of laterally-extending upper ridges 120 that may be like those of the upper receiver rail portion and also generally equally spaced apart and extending along the elongated handguard rail portion. One or more openings 122 that are similar to opening 114 of the upper receiver rail portion 108 may be added to accommodate an optional rifle accessory (not illustrated). A partial slot 124 is created at one end of the handguard rail portion.

In assembled form, upper receiver portion 102 aligns with and is adjoined to handguard portion 104 such that the upper receiver rail portion 108 and handguard rail portion 118 are in a confronting relationship at the two partial slots to form one (completed) slot 126 of a size and shape to accept the integrated leveler assembly 10. Alternatively, slot 126 may be integrally formed with a one piece rail platform (such as illustrated in FIG. 4).

Slot 126 may be formed from a pair of outwardly extending protuberances 128 that are opposite and spaced-apart from each other with a laterally-spanning channel 130 therebetween. Each protuberance 128 may further include a tapped screw hole 132. If an imaginary axis split the slot in half either laterally or longitudinally, the two halves of the slot would be mirror images of each other according to this embodiment.

Figure 4:
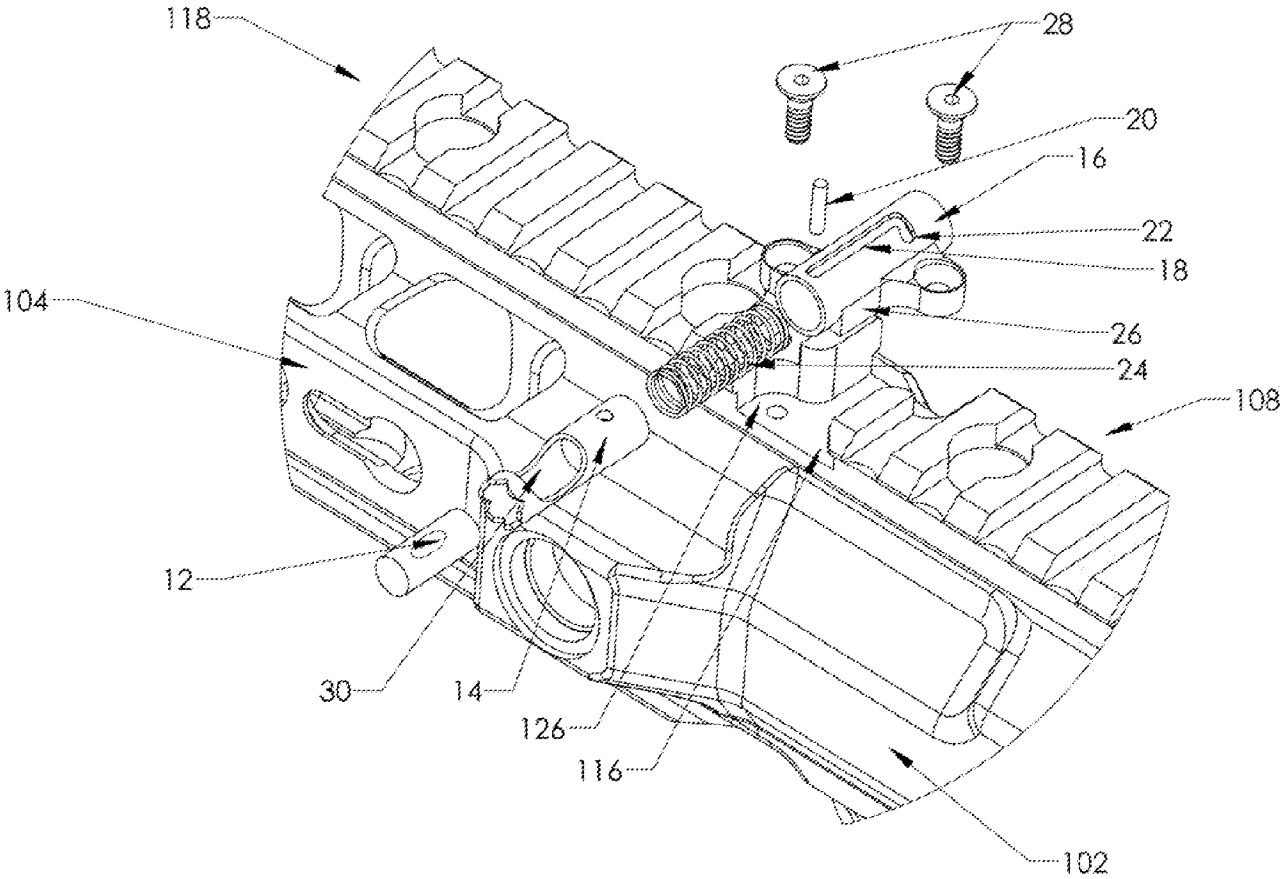
FIG. 4 is an exploded view of the integrated leveler assembly better illustrating the spring and lock pin, guide slot, and retaining screws.

Now referring particularly to FIGS. 2-7, integrated leveler assembly 10 is comprised of a level vial 12, a level vial barrel receiver which may be a unitary device (not illustrated), or which may include a separate level vial receiver 14, a barrel 16, a guide slot 18, a lock pin 20, a cam lock 22, an extension spring 24, flanges 26, and retaining screws 28. As illustrated in FIG. 4, which discloses an exploded view of the integrated leveler assembly, level vial 12 is of a size and shape to be axially received into level vial receiver 14. Level vial receiver 14 includes a relatively large opening 30 to expose a significant portion of the level vial 12 to outside view when the level vial is inserted into the level vial receiver.

One of skill in the art would know that the level vial would be nearly completely filled with a liquid 32 normally an alcohol, such as ethanol, and be colored (typically in a highly-visible color such as yellow or lime-green). A bubble 34 is created within the liquid within the level vial 12 and such bubble is visible between lines or guides when the level vial is horizontal (level). Outer edges of level vial receiver 14 that form opening 30 may function as the guide for purposes of determining when the level vial/level vial receiver are horizontal (level). Alternatively, guide lines can be added to the level vial itself to indicate the placement of the bubble to indicate the level vial is horizontal (level).

Level vial receiver 14 is of a size and shape to be axially received within barrel 16 as well illustrated in FIGS. 2-7. Extension spring 24 is positioned between the receiving end of level vial receiver 14 and barrel 16. The spring is biased against a closed end 36 of barrel 16. Guide slot 18, cam lock 22, which may be a small dog-legged slot off the guide slot, and lock pin 20 allow level vial receiver 14 to move between an open position (FIG. 3) where the level vial bubble is visible within the opening of the extended level vial receiver and a closed position (FIG. 2) where the level vial receiver is encased within the barrel when anti-cant (leveling) function is not required. Lock pin 20 is of a size and shape to be received though an opening 38 within level vial receiver 14 near its receiving end 39.

Figure 2:
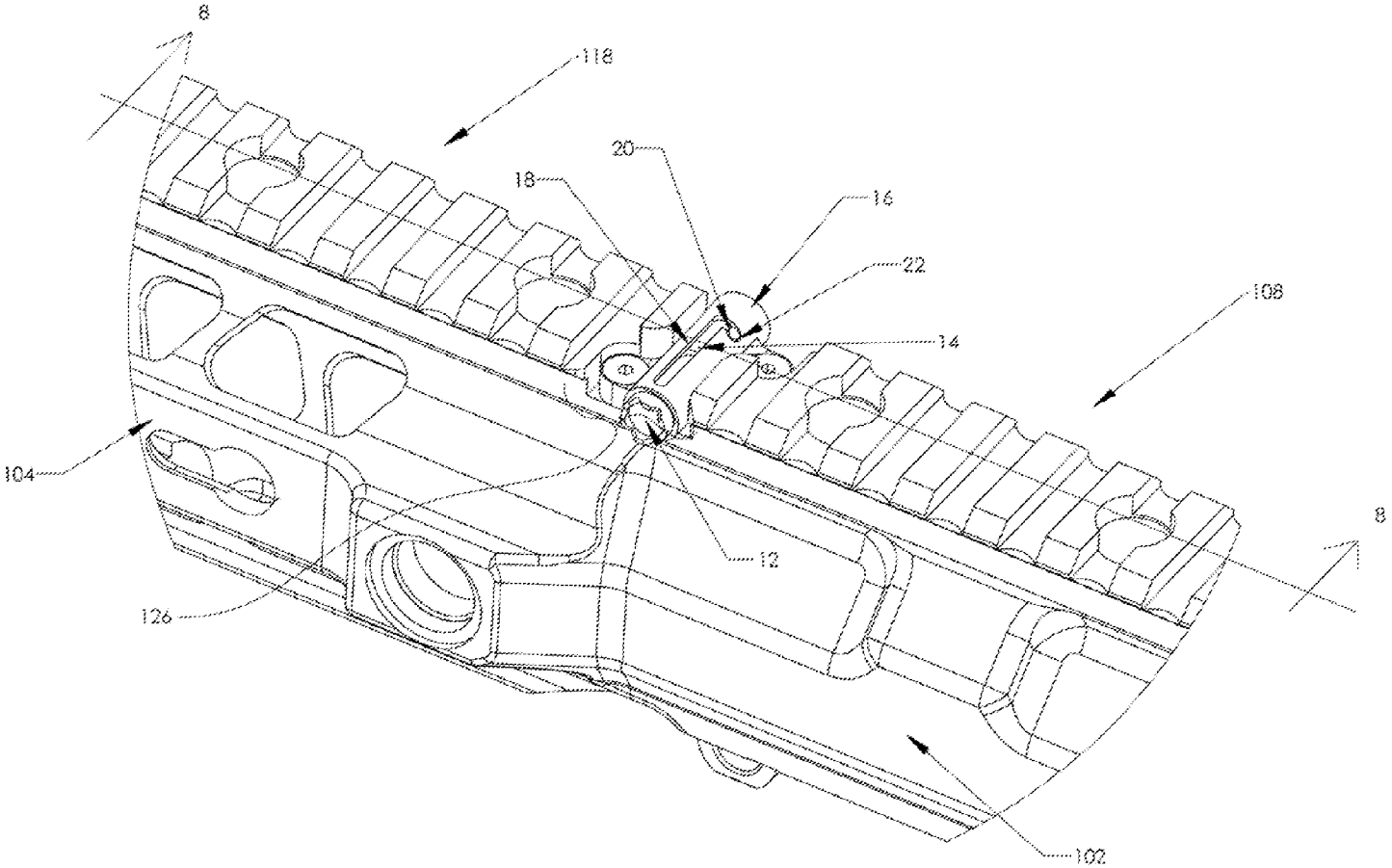
FIG. 2 is an enlarged detail view of the integrated leveler assembly of FIG. 1, except rotated 60 degrees and better illustrating one aspect of the invention with a level vial axially inserted and retained within a level vial receiver, which is axially inserted within a barrel.
Figure 3:
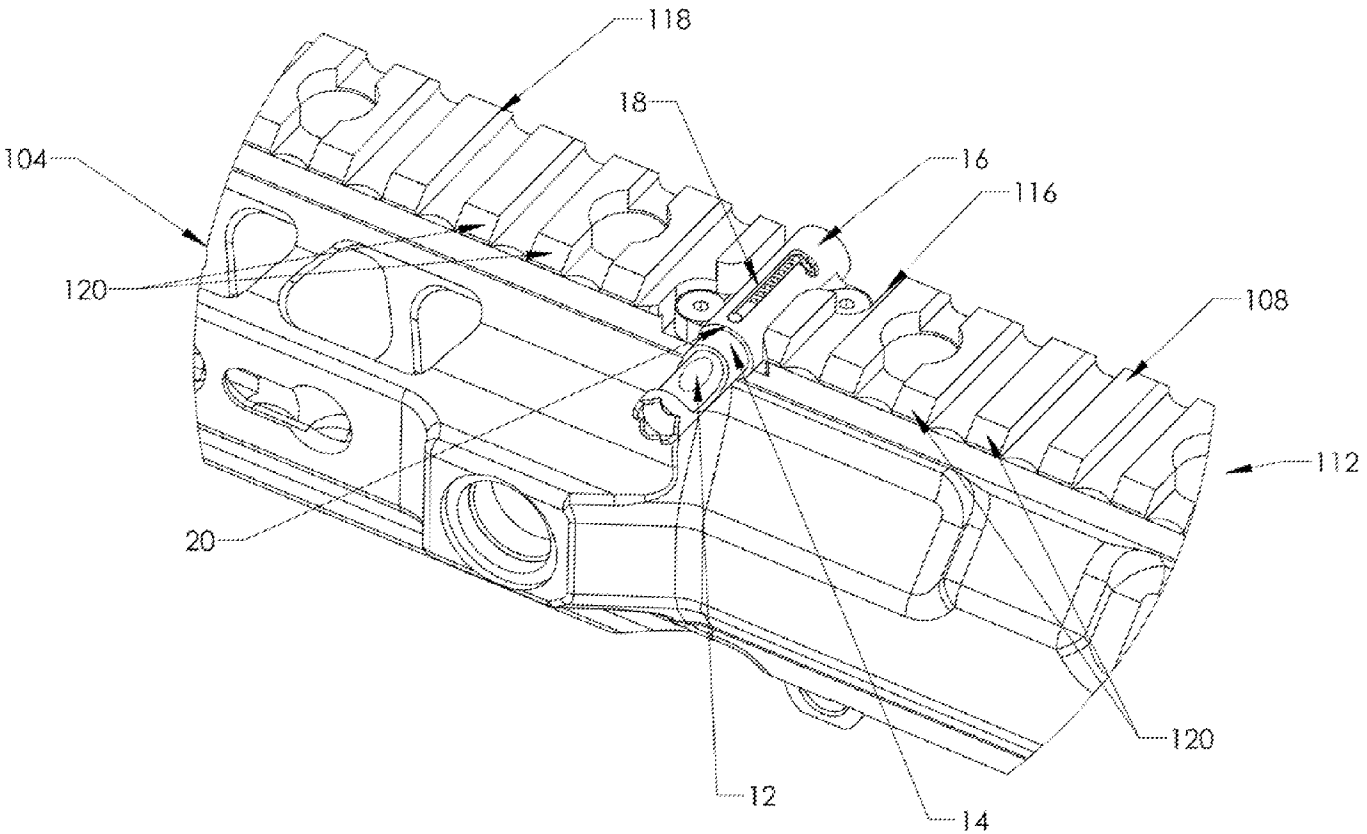
FIG. 3 is an enlarged view like FIG. 2, except that the level vial is axially extending from the barrel and exposing an opening in which to view a level liquid bubble within the vial.
Figure 5:
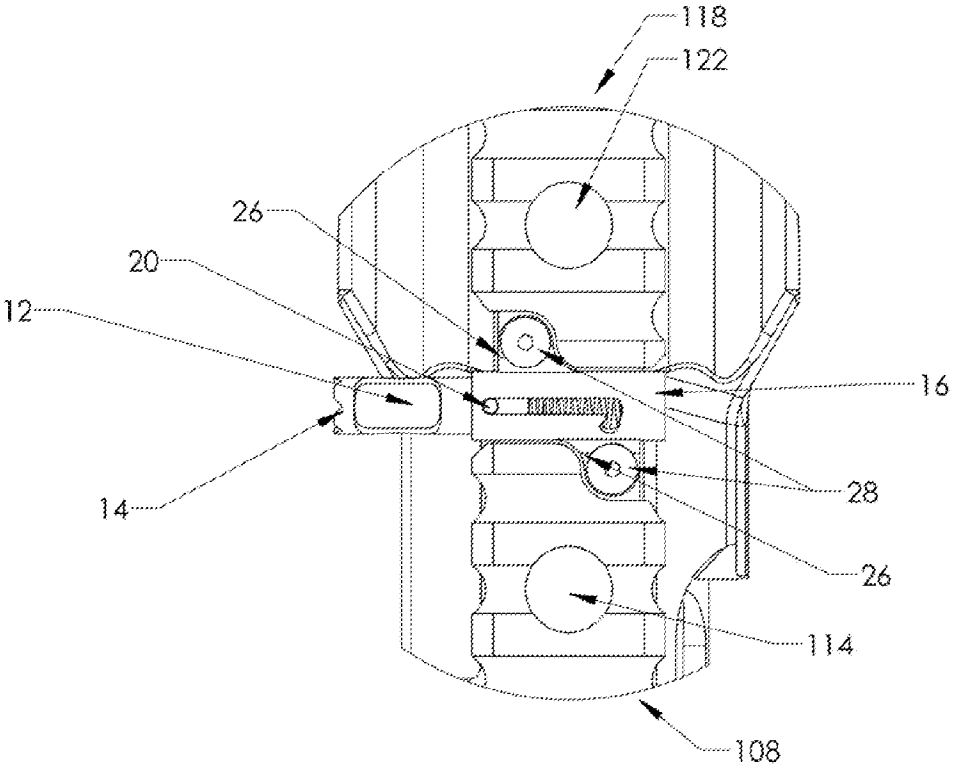
FIG. 5 is a top view of the assembled integrated leveler between the rail platforms of the respective upper receiver and handguard.
Figure 6:
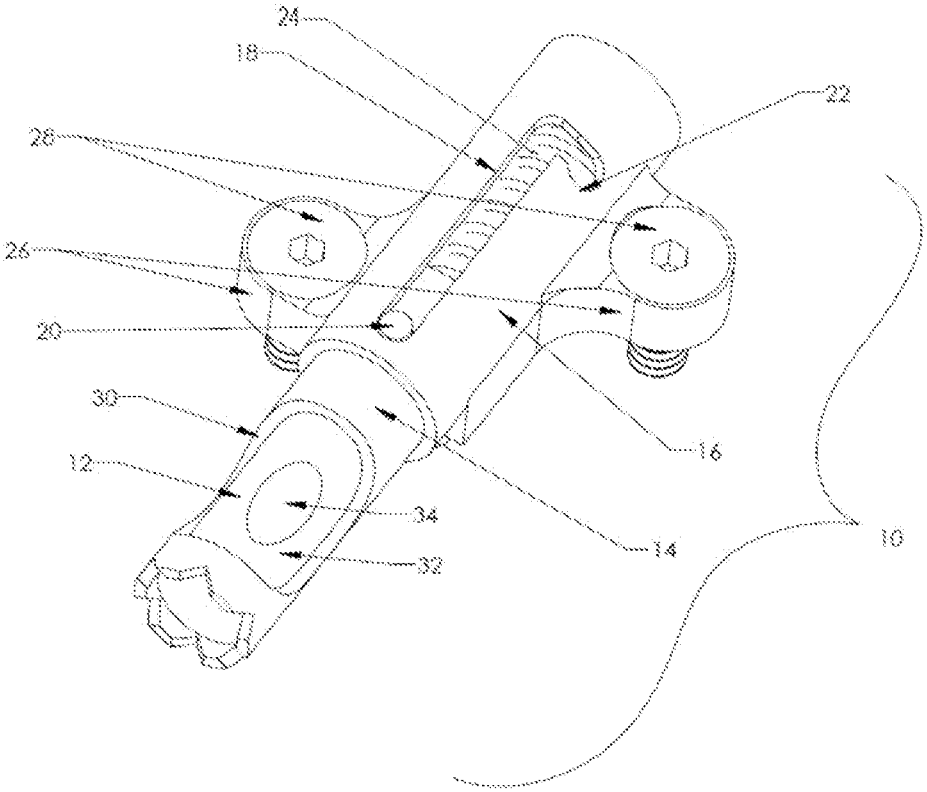
FIG. 6 is an enlarged view of the integrated leveler shown in assembled form but with the level vial and level vial receiver shown in the extended position relative to the barrel.
Figure 7:
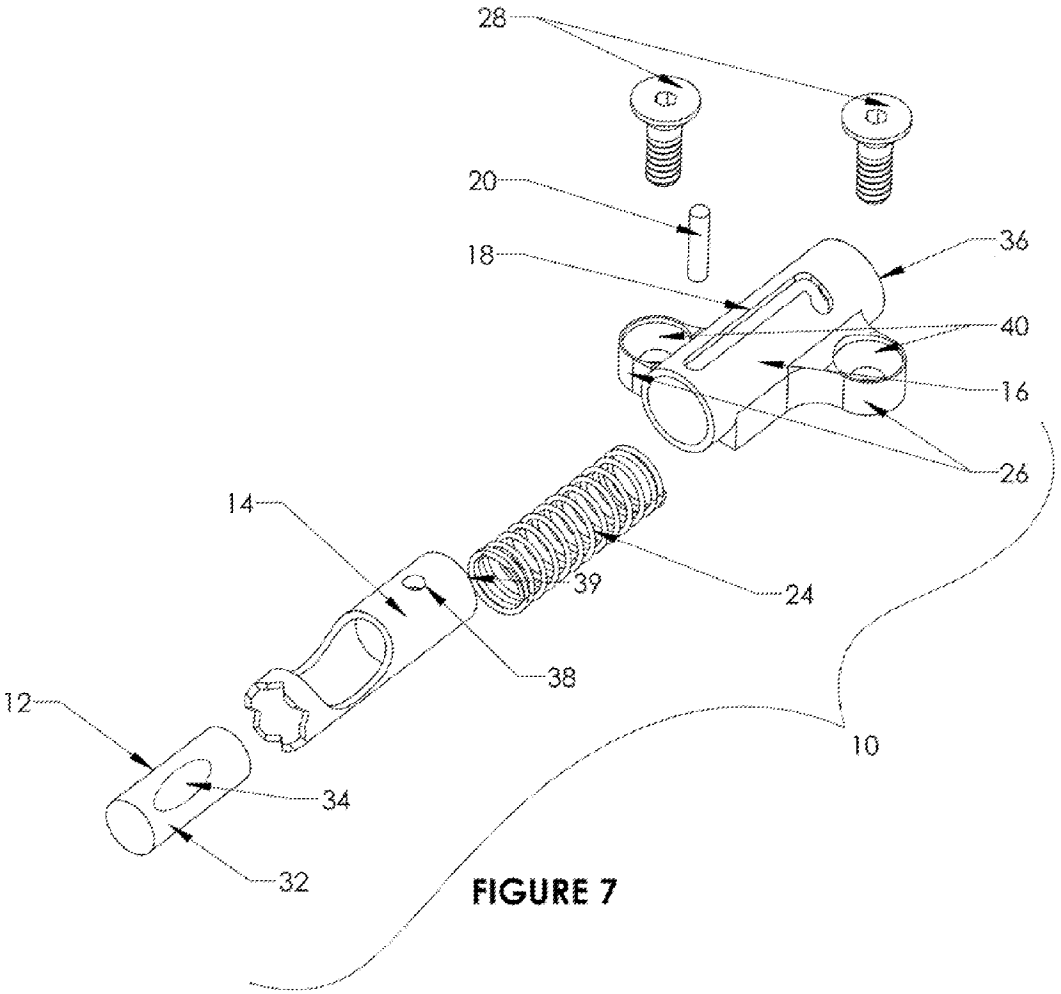
FIG. 7 is an exploded view of FIG. 6.
Figure 8:
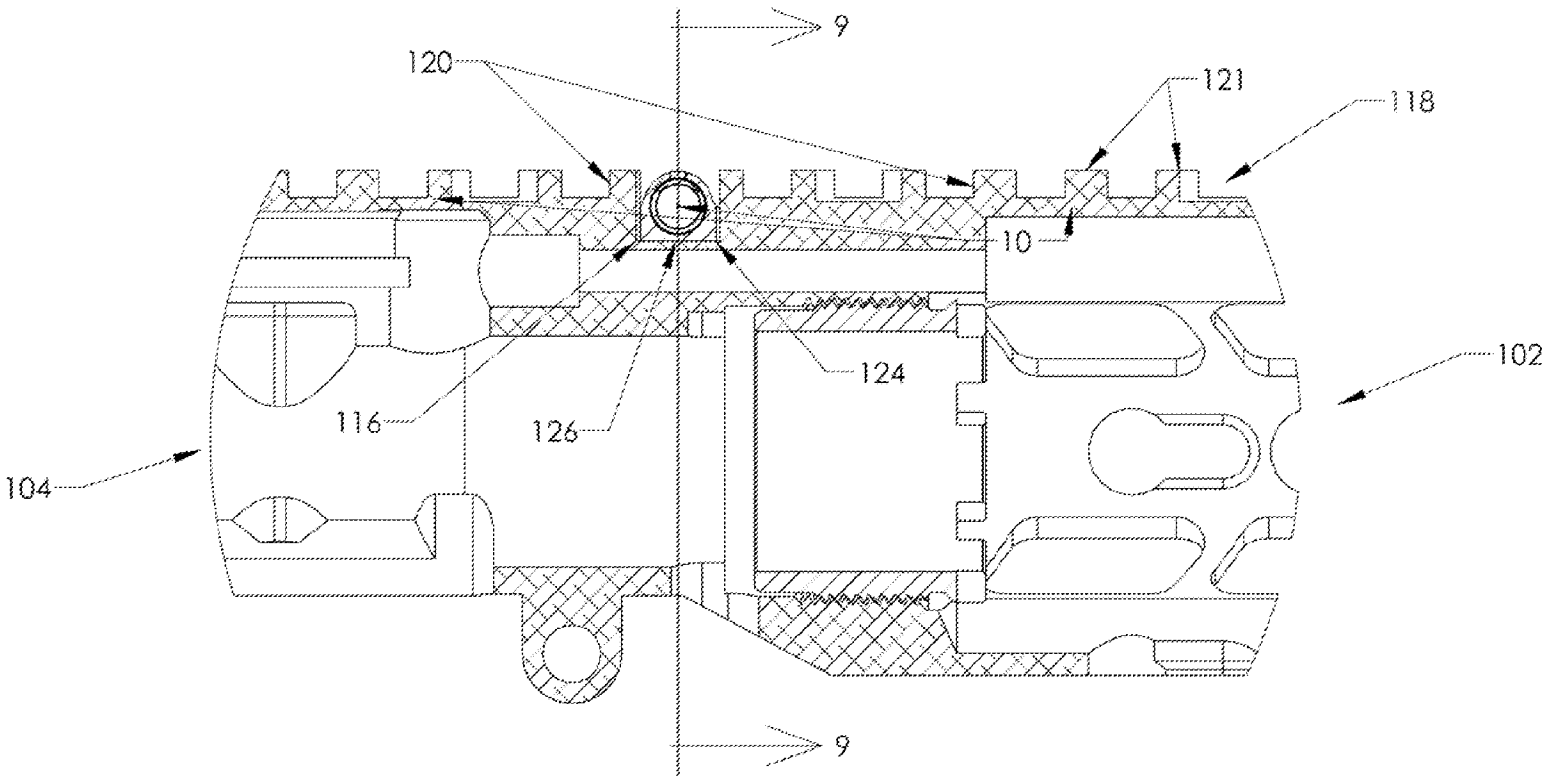
FIG. 8 is a cutaway section view taken substantially along lines 8-8 of FIG. 2 of the assembled integrated leveler assembly, rail portions with outwardly extending upper ridges having top portions, and upper receiver, and handguard, and illustrating how the integrated leveler is positioned beneath the top portions of the adjacent upper ridges.

When the level vial receiver goes into the closed position, an axial force is applied to the non-receiving end of the level, which biases the extension spring against the closed end of barrel 16, and compresses the spring so that the lock pin can move into the cam lock. When the lock pin is positioned within the cam lock, the level vial/level vial receiver is locked into the closed position (FIGS. 2, 5). To unlock the level vial/level vial receiver from the barrel, the lock pin is displaced from the cam lock and the level vial/vial receiver. The extension spring uncoils and pushes against receiving end 39 of the level vial receiver and the level vial where the bubble in the level vial is visible through opening 30 of level vial receiver 14.

The non-receiving end of the level may be knurled, as illustrated (particularly in FIG. 6), in order to lock and unlock the integrated leveler relative to the combined upper receiver/handguard assembly with a single fingertip.

Referring particularly to FIGS. 11-14, flanges 26 extend outwardly of barrel 16. The outline shape of the flanges and the barrel comport to the shape of slot 126 between elongated upper receiver rail portion 108 and elongated handguard rail portion 118 with the barrel 16 being received into the channel of slot 126 and the flanges are of a size to be received within protuberances 128. Flanges 26 define flange openings 40 that are of a size and shape to accept fasteners 28 (e.g., retaining screws). Fasteners 28 retain the integrated leveler assembly within slot 126 and joins elongated upper receiver rail portion 108 to elongated handguard rail portion 118. Once the integrated leveler assembly is fastened to the two rail portions spanning the upper receiver portion and the handguard portion, the upper rail appears to be a near continuous and aligned rail member spanning across the upper receiver portion 102 and handguard portion 104.

In one form of the invention, flanges 26 are spaced apart and oppositely situated from each other relative to the leveler barrel 16. Each flange may be positioned near an end of the barrel, one at one end and the other at the other end. Each flange corresponds to the outwardly extending protuberance 128 of slot 126 with the barrel 16 being received into channel 130. In this way, the leveler is rotatable 180 degrees and can be secured to slot 126 via the holes 132 through fasteners 28. In this manner, the integrated leveler can be accommodated into slot 126 for either right or left hand operations. To switch between the two operations, fasteners 28 are removed and the leveler is rotated 180 degrees and refastened into the slot.

When the upper receiver portion 102 and handguard portion 104 are assembled with the remaining rifle components (e.g., a butt stock, a lower receiver including a trigger assembly, a bolt carrier, and a rifle barrel assembly), the integrated leveler assembly along with the combined upper receiver/handguard portion forms improved anti-cant (leveling) functionality over the prior art anti-cant add-on accessories currently available. This is because the integrated leveler assembly is fixedly attached to both the handguard portion and the upper receiver portion between the two rail portions and there is less "play" (room for movement) between them. Additionally, the level vial/level vial receiver/barrel is aligned with the upper ridges of the rail portions and can be positioned to not extend above top portions 121 of upper ridges 120 (see section view of FIG. 8) so that the integrated lever assembly does not extend upwardly from the rail assembly which could impair visibility during use.

Figure 9:
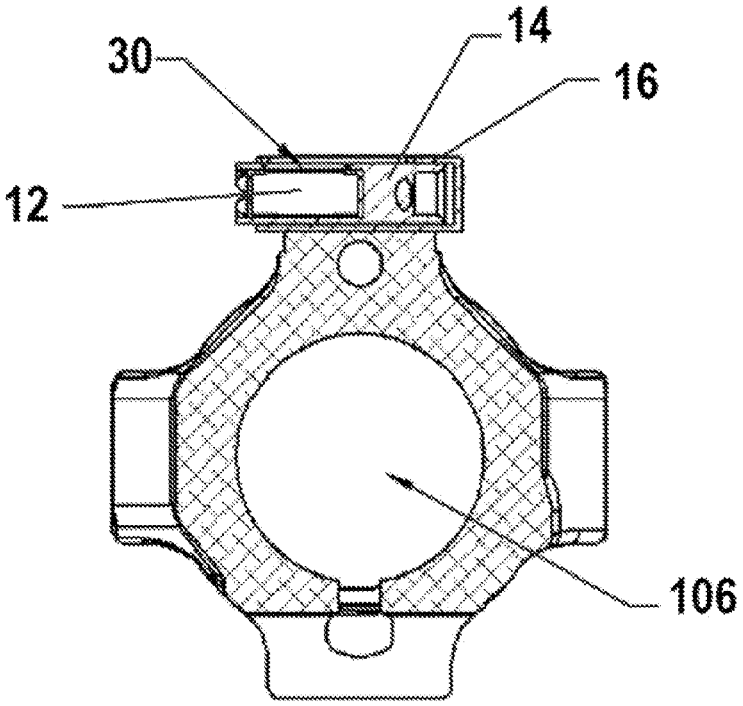
FIG. 9 is a cross section view taken substantially across lines 9-9 of FIG. 8 and illustrating the compact size of the integrated leveler when in the closed and locked position.
Figure 10:
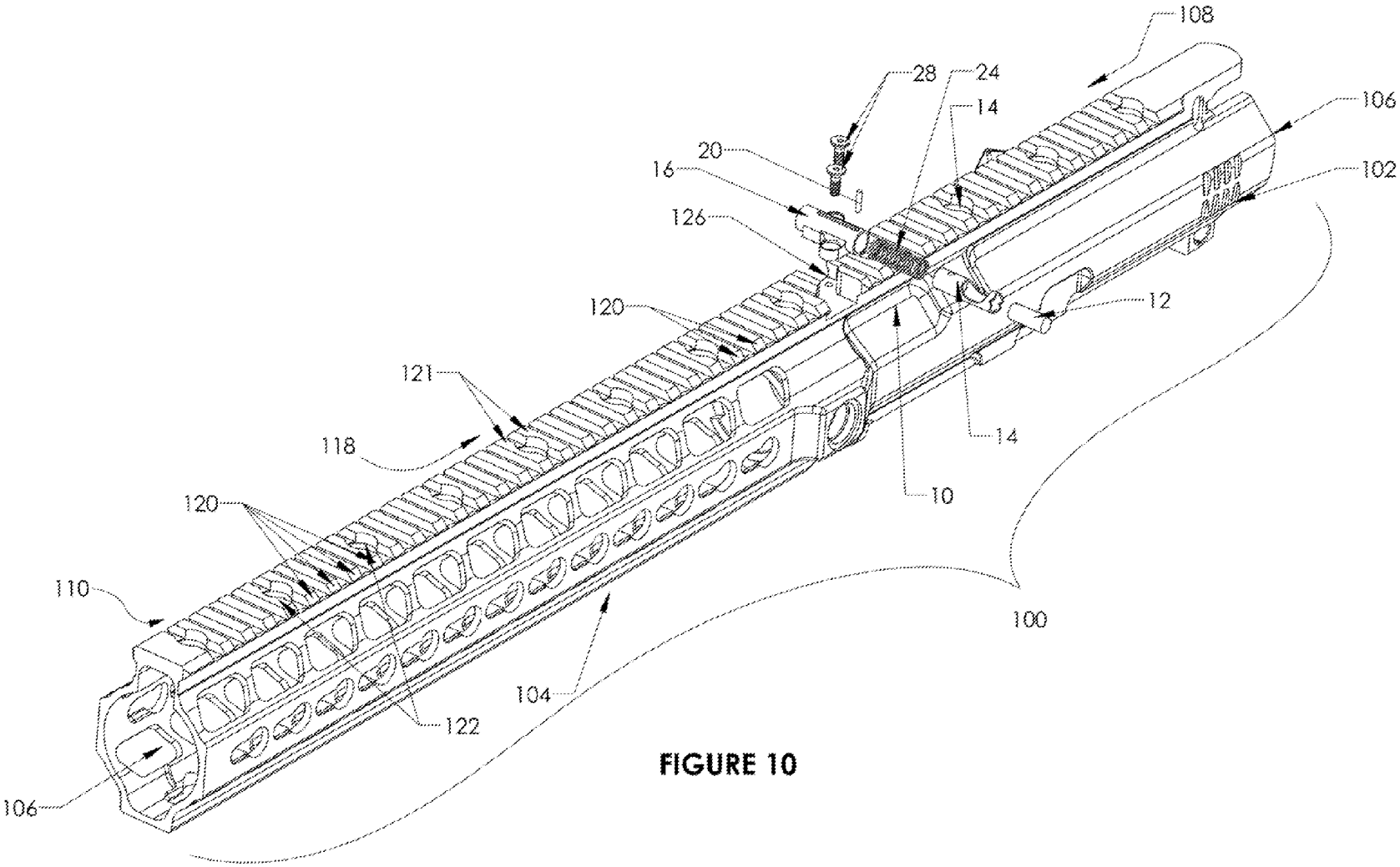
FIG. 10 is an exploded view of the integrated leveler in connection with an assembled view of the combined upper receiver and handguard.
Figure 11:
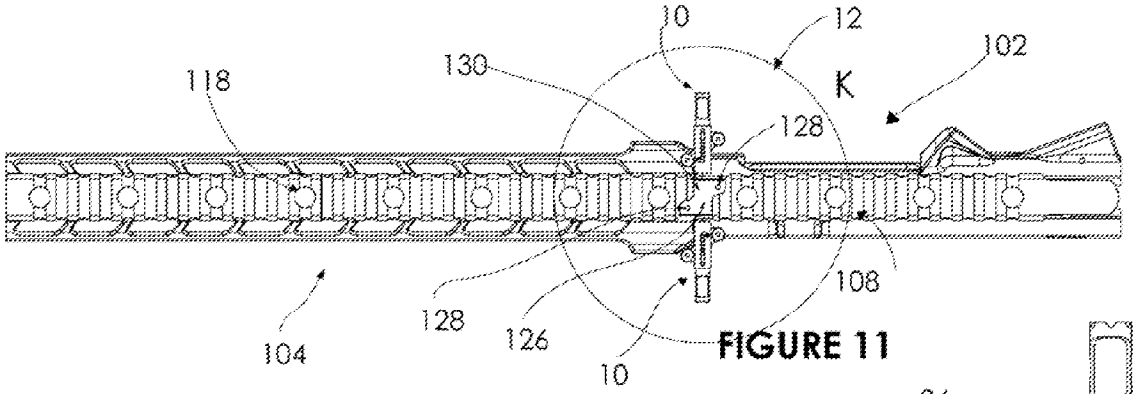
FIG. 11 is a top view of the upper receiver rail portion and the handguard rail portion with the slot therebetween and illustrating that the integrated leveler can be installed for either right hand or left hand operation.
Figure 12:
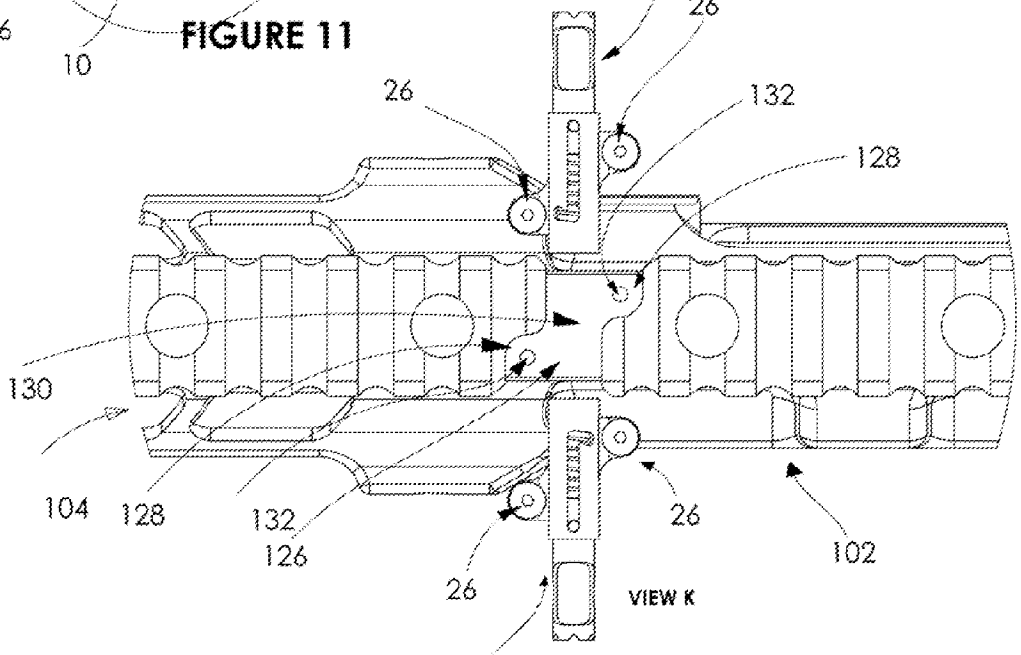
FIG. 12 is an enlarged view of circle 12 of FIG. 11 better illustrating the slot between the elongated handguard rail portion and the upper receiver rail portion and how the slot can receive the integrated leveler in one of two orientations.
Figure 14:
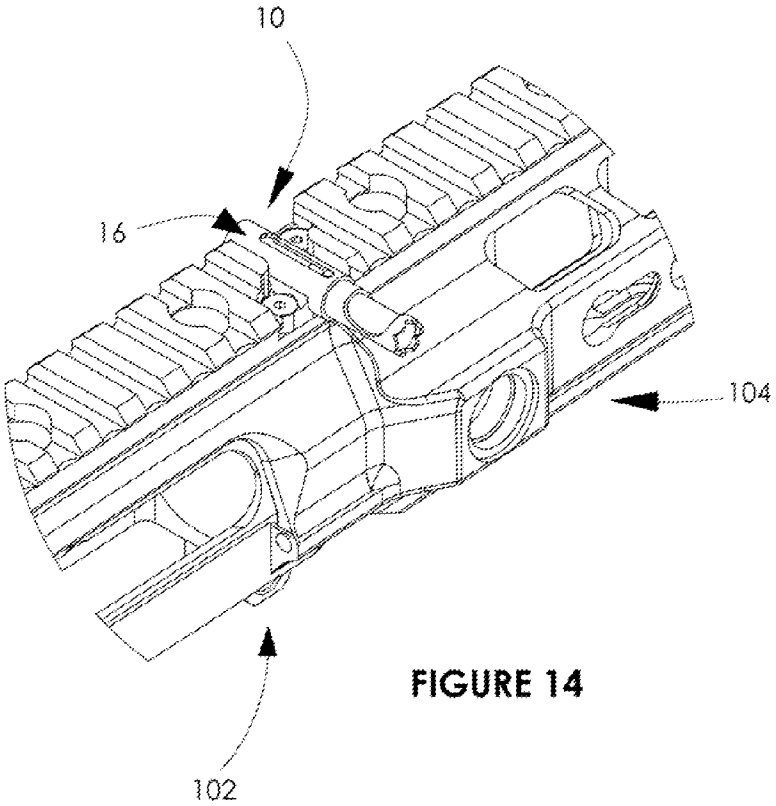
FIG. 14 is a perspective view like that of FIG. 13 except rotated to illustrate the installation of the integrated leveler for right hand operation.
Figure 13:
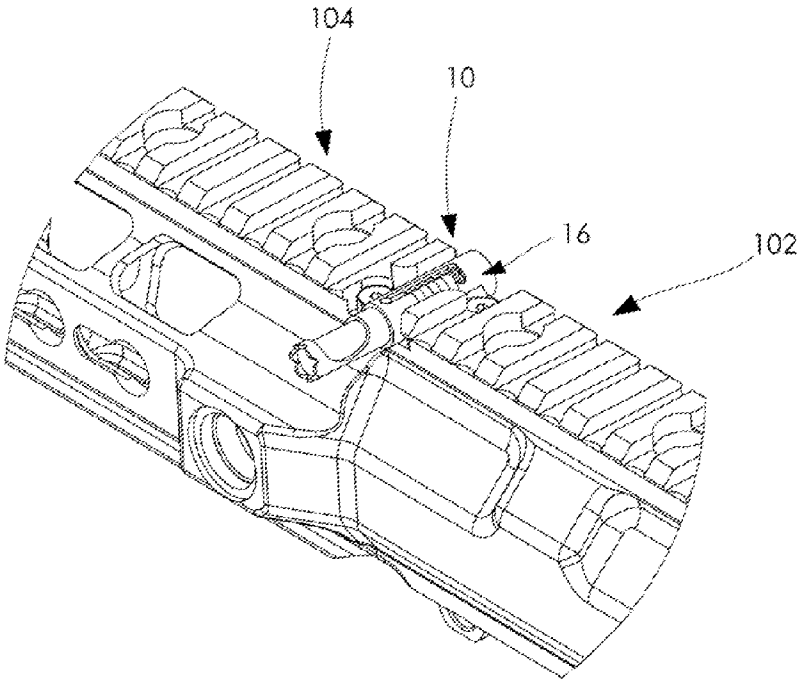
FIG. 13 is a perspective view of the circle of FIG. 11 but illustrating the installed integrated leveler for left hand operation.

Referring particularly to FIG. 9, further, when the level vial/level vial receiver are in the closed and locked position (FIG. 9), the integrated level assembly barely extends past the lateral sides of the rail portions. Thus, the integrated leveler assembly keeps a small footprint and does not mar a rifle user's field of vision, stays intact (rather than needing to be added and removed as prior art anti-cant accessories are now), is less likely to cause entanglement with brush or clothing, and is less likely to be damaged during rifle transportation and storage. Additionally, the speed and ease of moving the leveler assembly into the open position makes the invention well suited for military and police rifle training (for improved shot quality).

These few examples and embodiments, which are by no means exhaustive, are merely intended to illustrate some of the many variations that can occur without departing from the spirit of the invention.

The invention claimed is:

1. A firearm assembly comprising:

an upper receiver portion having a longitudinal bore therethrough and wherein the upper receiver portion is configured to receive a bolt carrier of a rifle, said upper receiver portion including an elongated upper receiver rail portion having a partial slot at one end;

a handguard portion having a longitudinal bore therethrough and wherein the handguard portion is configured to receive a barrel assembly of the rifle, said handguard portion including an elongated handguard rail portion having a partial slot at one end;

wherein the elongated upper receiver rail portion aligns end-to-end with the elongated handguard rail portion such that the two partial slots align to form one completed slot between the two rail portions to form an elongated rail platform;

an integrated leveler assembly being of a size and shape to be received within the completed slot, said integrated leveler assembly including a liquid-filled level vial that forms bubble within the level vial, wherein said bubble is externally visible, and a level vial barrel receiver of a size to receive the liquid vial, said level vial barrel receiver having an opening to expose the bubble of the level vial when the integrated leveler assembly is level; and one or more fasteners to secure the level vial barrel receiver to the elongated upper receiver rail portion and to the elongated handguard rail portion within the completed slot.

2. The firearm assembly according to claim 1 wherein the level vial barrel receiver further comprises:

a level vial receiver that axially receives the level vial and contains an opening to expose the bubble of the level vial when the integrated leveler assembly is level;

a barrel configured to axially receive the level vial receiver, the barrel including an elongated guide slot having two ends with a cam lock slot contiguous with the elongated guide slot at one end of the guide slot;

an extension spring positioned between an end of the level vial receiver and inside the barrel; and an outwardly extending lock pin that is secured to an end portion of the level and is configured to move along the guide slot of the barrel between the cam lock slot and the other end of the guide slot.

3. The firearm assembly according to claim 1 wherein the rail platform has a plurality of upwardly extending and spaced apart ridges, each ridge having a top portion, wherein each ridge laterally spans the rail platform; and wherein the level vial barrel receiver is received within the completed slot between two ridges with one ridge on the rail portion corresponding to the upper receiver and the other ridge corresponding to the handguard and the level vial barrel receiver does not extend beyond the top portions of the two adjacent ridges.

4. The firearm assembly according to claim 2 wherein the rail platform has a plurality of upwardly extending and spaced apart ridges, each ridge having a top portion, wherein each ridge laterally spans the rail platform; and wherein the barrel is received within the completed slot between two ridges with one ridge on the rail portion corresponding to the upper receiver and the other ridge corresponding to the handguard and the barrel does not extend beyond the top portions of the two adjacent ridges.

5. The firearm assembly according to claim 1 wherein integrated leveler assembly is capable of conforming to the completed slot in a first position and in a second 180 degree rotated position.

6. The firearm assembly according to claim 1 wherein the upper receiver portion and handguard portion are unitary in construction.

7. The firearm assembly according to claim 2 wherein the level vial receiver includes an exposed knurled edge.

* * * * *